US005523194A

United States Patent [19]

Archer

[11] Patent Number: 5,523,194

[45] Date of Patent: Jun. 4, 1996

[54] FOUNT SOLUTIONS FOR PLANOGRAPHIC PRINTING PROCESSES

[75] Inventor: Margaret Archer, Leeds, England

[73] Assignee: E. I. Du Pont de Nemours and Company, Wilmington, Del.

[21] Appl. No.: 456,400

[22] Filed: Jun. 1, 1995

[30] Foreign Application Priority Data

Sep. 16, 1994 [GB] United Kingdom ..... 9418743

[51] Int. Cl.[6] ..... B41N 1/00; G03C 5/00

[52] U.S. Cl. ..... 430/331; 101/451; 106/2; 106/14.13

[58] Field of Search ..... 430/331; 106/2, 106/14.13; 101/451

[56] References Cited

U.S. PATENT DOCUMENTS

| | | | |
|---|---|---|---|
| 4,342,596 | 8/1982 | Conner, Sr. | 106/14.13 |
| 4,548,645 | 10/1985 | Thiebaut | 106/2 |
| 4,820,344 | 4/1989 | Geke et al. | 106/14.13 |
| 4,965,334 | 10/1990 | Mohr et al. | 528/34 |
| 5,286,606 | 2/1994 | Rahman et al. | 430/311 |

FOREIGN PATENT DOCUMENTS

| | | | |
|---|---|---|---|
| 0108883A3 | 5/1984 | European Pat. Off. | B41N 3/08 |
| 0242900A3 | 10/1987 | European Pat. Off. | C09K 5/00 |
| 4032049A1 | 4/1992 | Germany | C10M 173/02 |
| 2008495 | 6/1979 | United Kingdom | B41N 1/00 |
| 90/03419 | 4/1990 | WIPO | C09D 9/00 |

*Primary Examiner*—Cynthia Hamilton

[57] ABSTRACT

Corrosion inhibiting fount solutions are provided that contain water, an alkanoic acid, a di- or ti- alkanolamine, a benzoic acid, and a carboxylic acid.

5 Claims, No Drawings

FOUNT SOLUTIONS FOR PLANOGRAPHIC PRINTING PROCESSES

FIELD OF THE INVENTION

The present invention relates to planographic printing processes and, more particularly, to fount solutions that are particularly useful in planographic printing processes.

BACKGROUND OF THE INVENTION

Planographic printing plates, such as lithographic plates, have image regions and non-image regions which are essentially co-planar. The image regions are formed from a hydrophobic, oleophilic material to which greasy printing inks are attracted. The non-image regions are formed from a hydrophilic, oleophobic material from which the greasy printing ink is repelled. Thus, on application of the greasy printing ink to the printing plate, the ink is attracted to, and retained on, the image areas and repelled from the non-image areas. The ink can thus be transferred from the printing plate to the printing substrate to produce an image on the printing substrate corresponding to the image areas of the printing plate.

A fount solution is conventionally used to assist in maintaining the hydrophilic properties of the non-image areas and to prevent scumming of the ink into the non-image areas. It is usual to use a polar liquid for this purpose, and water itself may perform satisfactorily as a fount solution for a short time. An aqueous solution including various performance enhancing additives is more commonly used as a fount solution. The performance of the fount solution is optimized to ensure that the solution is repelled by the image areas and is retained on and wets the non-image areas of the plate. Additives may also be used to control the interaction of the fount solution with the ink and the substrate. Known additives include aqueous electrolytes, surfactants and water-soluble polymers.

Various methods have been employed to apply the fount solution to the printing plate. In many conventional lithographic presses, the means used to apply the fount solution (the "dampening system") is entirely separate from the means used to apply the printing ink. In an example of such a method, the fount solution is transferred from a reservoir by a first roller, which is partially immersed in the fount solution, to a second ductor roller. The ductor roller transfers the fount solution (directly or indirectly) to the form rollers which contact the printing plate. The ductor roller oscillates between the first roller and the form rollers (or their precursors) so that contact with each is intermittent, whereby the amount of fount solution which is applied to the plate can be controlled.

In alternative methods, which attempt to avoid transfer of ink from the printing plate to the dampening system, the fount solution is transferred from the first roller to a brush roller. When rotating, the brush roller flicks droplets of the fount solution onto the form rollers or directly onto the printing plate. Similarly, nozzles can be used to spray a line mist of fount solution onto the plate or the form rollers. In another method, the printing plate is contacted only by the inked form rollers. The fount solution must then be transferred from the dampening system to the printing plate via one or more inked rollers.

Each of these alternative methods of application has prolonged direct contact of parts of the lithographic press, such as rollers, nozzles and bearings, with the fount solution. In general, such parts are comprised of metal, especially steel and nickel plated steel, and it has been found that the fount solutions commonly in use are prone to attack these areas of the press, giving rise to corrosion of the various pans. In particular, areas of the press constructed of electroplated nickel are especially vulnerable to attack. The incidence of such corrosion is clearly undesirable, requiring regular and costly replacement of the various pans and, on occasions, resulting in termination of printing runs due to movement of the printing plates on the press, caused by the presence of ill-fitting corroded parts. The corrosion may be associated with any of a number of individual components of the fount solution.

A wide range of corrosion inhibitors have been suggested in the prior art for various applications. Benzimidazole derivatives and various phosphonate and phosphate compounds are typical examples. Many corrosion inhibitors are commercially available under trade names such as Preventol, Cortec, Korantin and Nalco. However, it has previously been :found that many such commercially available corrosion inhibitors are unsuitable or ineffective when used in fount solutions employed on lithographic printing presses.

Corrosion inhibitors typically operate by forming a protective film around the material to be protected. Inevitably, the film will surround the printing plate as well metallic parts of the printing press. Presence of the film on the printing plate, however, causes a reduction in the differential between the hydrophobic image areas and the hydrophilic non-image areas, which differential is the basis of the lithographic printing process. Thus, fount solutions of this type tend to suffer from either uniform excessive ink acceptance, in which case scumming of the background areas becomes apparent; or uniform inadequate ink acceptance, in which case image areas suffer frown "blinding", resulting in poor image quality. In either case, the use of such fount solutions leads to totally unsatisfactory results during printing.

Manufacturers of commercial fount solutions heretofore have attempted to overcome these problems of printing plate performance, while providing corrosion protection for the printing press, by incorporating triazole derivatives such as benzotriazole and tolyltriazole in the fount solution. Whilst the printing results observed with such founts are in some respects satisfactory, the degree of corrosion protection afforded by the inhibitors falls well short of the levels that would be desired. Corrosion of vulnerable parts of the press comprising nickel plated steel, though reduced, is still significant and no protection is afforded to the non-plated steel press parts.

Thus there remains a need for improved fount solutions that enable the printer to produce high quality prints, free from background contamination, while affording a high degree of protection to metal parts of the printing press.

SUMMARY OF THE INVENTION

The present invention provides a fount solution that enables the printer, in a planographic printing process, to produce high quality prints free of background contamination, while affording a high degree of protection to metal parts of the printing press. The fount solution comprises water, an alkanoic acid, a di- or tri- alkanolamine, a substituted or unsubstituted benzoic acid, and a corrosion inhibiting surfactant that is an alkoxy, aryloxy, or alkaryloxy carboxylic acid.

In a preferred embodiment, the surfactant has the formula:

$$R(OC_2H_4)_nOCH_2CO_2H$$

where R is an alkyl group and n is an integer of 1 to 30. Various other ingredients may be present to modify performance of the fount solution.

DETAILED DESCRIPTION OF THE INVENTION

Planographic printing plates in general, and lithographic printing plates in particular, that may be used to advantage in practicing the invention are well known in the art. The printing plate typically has a hydrophilic substrate (such as a metal sheet, typically aluminum) coated with a layer of radiation sensitive material. Upon exposure to radiation, a solubility differential is created between the exposed and non-exposed areas.

The exposure is generally performed through a mask, or more recently using a laser, to create the desired image of exposed and non-exposed areas of the coating. The, the coating is treated with a suitable developer solution to remove the more soluble areas, revealing the underlying substrate. The less soluble areas are retained on the substrate. Thus, the substrate forms the non-image areas and the coating which remains after development forms the image areas.

The invention provides a fount solution containing ingredients that interact synergistically to effectively inhibit corrosion of printing press components, while enabling the printer to obtain high quality prints. The fount solution typically is sold as a concentrate that is diluted before use in the printing process.

The fount solution concentrate is an admixture of:

(a) water;

(b) an alkanoic acid;

(c) a di or tri alkanolamine;

(d) a benzoic acid, which may be substituted; and (e) a corrosion inhibiting surfactant that is an alkoxy, arlyoxy, or alkaryloxy carboxylic acid, or mixture thereof.

In preferred embodiments, the alkanoic acid is a carboxylic acid having 1 to 12 carbon atoms, preferably 6 to 10 carbon atoms. Octanoic acid is particularly preferred.

The alkanolamine preferably is a tri-lower alkanolamine, with triethanolamine being particularly preferred. Benzoic acid, or a substituted benzoic acid may be selected. For example, palky substituted benzoic acids, preferably those having 1 to 8 carbon atoms in the alkyl group, may be selected to advantage. Particularly favorable results have been achieved with p-tert-butyl benzoic acid.

The corrosion inhibiting surfactant is an alkoxy, aryloxy, or alkaryloxy carboxylic acid, or mixture thereof. Preferred surfactants are alkoxy carboxylic acids having the formula:

$$R(OC_2H_4)_nOCH_2CO_2H$$

where R is an alkyl group and n is an integer between 1 and 30. Particularly favorable results have been obtained with surfactants which are mixtures of acids wherein R is an alkyl group having 6 to 8 carbon atoms, with mixtures of such acids having 4 to 8 carbon atoms yielding even more favorable results. For example, Akypo LF4, and, especially Akypo LF6, both sold by Chemische Fabrik Chem-Y GmbH, wherein n is 7 and 5, respectively, can be selected to particular advantage.

The particular components are selected such that the combination is soluble in aqueous media. In that regard, it has been found that the corrosion inhibiting surfactant not only serves that function, but also acts as a hydrotrope to increase solubility of the other components.

In the above fount solution concentrates, the alkanoic acid is present in an amount of from 0.01% to 60%, preferably from 0.1% to 10% volume/volume; the alkanolamine is present in an amount of from 0.01% to 60%, preferably from 0.1% to 15% volume/volume; the benzoic acid (which may be substituted) is present in an amount of from 0.01% to 60%, preferably from 0.02% to 8% weight/volume; and the corrosion inhibiting surfactant is present in an amount of from 0.01% to 60%, preferably from 0.1% to 20% volume/volume.

Various additives may be incorporated in the fount solution concentrate, or added by the printer as the concentrate is diluted for use in the printing process. Thus, in addition to water (which preferably is demineralized), the fount solution preferably will contain one or more of the following ingredients:

i) A wetting agent, which prevents ink receptivity in the non-image areas. Alkyl sulphates or alkanols containing 6 to 20 carbon atoms, typically 8 to 12 carbon atoms are particularly effective for this purpose. Preferred materials include ethyl n-hexanol and n-ethyl hexyl sulphate, commercially available under the trade name Rewopol NEHS.

ii) A buffer system; the inclusion of a buffer system is particularly desirable and the system will preferable comprise a salt and an acid. A pH of about 5.5 to 6.0 is preferred and the salt and the acid are preferably each present in an amount of from 0.5% to 10% weight/volume. Careful control of the precise buffer formulation can, in fact, assist in achieving reduced corrosion. Suitable salts include trisodium citrate, disodium succinate, sodium glycolate, sodium acetate, sodium tartrate, sodium lactate, disodium hydrogen phosphate, dipotassium hydrogen phosphate, sodium hydroxide and tripotassium citrate. Suitable acids include citric acid, succinic acid, phosphoric acid, lactic acid, tartaric acid, acetic acid, nitric acid and glycolic acid. Particularly preferred buffer systems comprise combinations of citric acid with either trisodium citrate or disodium succinate, and combinations of succinic acid with either trisodium citrate or disodium succinate. As an alternative to a combination of an acid and a salt, it is possible to utilize a buffer system comprising an alkane sulphonic acid containing an optionally substituted nitrogen-containing heterocyclyl ring and having the formula:

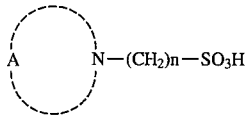

where A represents the ring atoms necessary to complete a 5- or 6-membered heterocyclic ring which may optionally be substituted, and n is an integer between 1 and 20, preferably between 1 and 5. The compound is preferably present in an amount between 1% and 20%, most preferably between 5% and 15% weight/volume. Particularly preferred examples of such compounds are 2-N-morpholinoethane sulphonic acid and 2-N-morpholino-n-propane sulphonic acid.

iii) A desensitizing agent; this additive acts to promote water receptivity and prevent or reduce ink receptivity in the non-image areas and is preferably present in an amount of from 0.5% to 20% weight/volume. A preferred desensitizing agent is dextrin, but other suitable agents include sodium carboxymethylcellulose, gum arabic, mesquite gum, guar gum, karaya gum and gum tragacanth.

iv) A film former; suitable film formers include glycerine and sorbitol. The film former is preferably present in an amount of up to 20% volume/volume.

v) A sequestrant; this additive acts to sequester any salts which might otherwise build up. Suitable sequestrants include borax, sodium hexametaphosphate (Calgon R) and salts of EDTA (ethylenediamine tetraacetic acid). Preferably, the sequestrant is present in an amount of up to 10% weight/volume.

vi) A biocide; this additive serves to prevent biological spoilage in the solution. The choice is not particularly limited and an amount of up to 10% volume/volume may be included. Preferred biocides include isothiazolinone derivatives sold under trade names such as Bacteron B6, Kathon 886 and Bactrachem BF1 or BF2. General preservatives such as dimethoxane, phenol, sodium salicylate and the like can also be used.

Other additives which may usefully be incorporated into these fount solutions include surfactants acting as wetting agents, anti-foaming or defoaming agents and dyes, such as are generally known in the art. Typical examples include commercially available modified polyethoxylated alcohol non-ionic surfactants such as Triton DF12 and defoaming agents including Airex 900.

The fount solutions of the present invention may be used on a wide variety of lithographic printing apparatus. Particular examples included those sold under the trade names Dahlgren, Roland, Miehlematic, Harris Duotron, Komorimatic, Alcolor and Millermatic. The formulations of the present invention are, as is customary in the art, supplied as fount solution concentrates which are diluted before use. All quantities in this specification refer to the fount solution concentrates and are based on the total compositions of the concentrates. The concentrates are diluted with water to form working strength solutions containing from 0.1% to 60% weight/volume of concentrate.

The following formulations are illustrative of the fount solution concentrates of the present invention:

EXAMPLE 1

A formulation was prepared which comprised the following:

| | |
|---|---|
| Glycerine | 5.0% v/v |
| Disodium succinate | 4.0% w/v |
| Succinic acid | 4.0% w/v |
| Borax | 2.0% w/v |
| Nonanoic acid | 3.0% v/v |
| Triethanolamine (90% in demineralised water) | 4.0% v/v |
| p-tert-Butyl benzoic acid | 1.0% w/v |
| Rewopol NEHS | 5.0% v/v |
| Akypo LF4 | 5.0% v/v |
| Gum Arabic | 7.0% w/v |
| Bacteron B6 | 3.0% v/v |
| Triton DF12 | 0.2% v/v |
| Airex 900 | 0.04% v/v |

the remainder being demineralised water and incidental impurities. One part by weight of the concentrate was diluted with 50 parts by volume of water to form a working strength fount solution.

EXAMPLE 2

A formulation was prepared which comprised the following:

| | |
|---|---|
| Glycerine | 6.0% v/v |
| 2-N-Morpholinoethane sulphonic acid | 15.0% w/v |
| Ethylenediaminetetraacetic acid | 4.0% w/v |
| Octanoic acid | 0.5% v/v |
| Triethanolamine (90% in demineralised water) | 0.5% v/v |
| p-tert-Butyl benzoic acid | 0.3% w/v |
| 2,2-Dimethylhexanol | 0.4% v/v |
| Akypo LF4 | 2.0% v/v |
| Dextrine | 7.0% w/v |
| Bactrachem BF2 | 3.0% v/v |
| Triton DF12 | 0.1% v/v |
| Airex 900 | 0.1% v/v |

the remainder being demineralised water and incidental impurities. One part by weight of the concentrate was diluted with 50 parts by volume of water to form a working strength fount solution.

EXAMPLE 3

A formulation was prepared which comprised the following: L

| | |
|---|---|
| Glycerine | 5.0% v/v |
| Disodium succinate | 4.0% w/v |
| Citric acid | 2.0% w/v |
| Borax | 4.0% w/v |
| Octanoic acid | 1.7% v/v |
| Triethanolamine (90% in demineralised water) | 3.0% v/v |
| p-tert-Butyl benzoic acid | 0.08% w/v |
| Rewopol NEHS | 6.0% w/v |
| Akypo LF6 | 2.5% v/v |
| Starch | 7.0% w/v |
| Bactrachem BF2 | 3.0% v/v |
| Triton DF12 | 0.025% v/v |

the remainder being demineralised water and incidential impurities. One part by weight of the concentrate was diluted with 50 parts by volume of water to form a working strength fount solution.

EXAMPLE 4

A formulation was prepared which comprised the following:

| | |
|---|---|
| Glycerine | 5.0% v/v |
| 2-N-Morpholinoethane sulphonic acid | 11.0% w/v |
| Borax | 4.0% w/v |
| Octanoic acid | 0.55% v/v |
| Triethanolainine (90% in demineralised water) | 1.0% v/v |
| p-tert-Butyl benzoic acid | 0.3% w/v |
| Rewopol NEHS | 2.0% v/v |
| Akypo LF4 | 2.5% v/v |
| Starch | 7.0% w/v |
| Bactrachem BF2 | 3.0% v/v |
| Triton DF12 | 0.025% v/v |

the remainder being demineralised water and incidental impurities. One part by weight of the concentrate was diluted with 50 parts by volume of water to form a working strength fount solution.

EXAMPLE 5

A formulation was prepared which comprised the following:

| | |
|---|---|
| Glycerine | 5.0% v/v |
| Trisodium citrate | 0.035% w/v |
| Citric acid | 0.085% w/v |
| Borax | 4.0% w/v |
| Octanoic acid | 1.7% v/v |
| Triethanolamine (90% in demineralised water) | 3.0% v/v |
| p-tert-Butyl benzoic acid | 0.08% w/v |
| Rewopol NEHS | 6.0% v/v |
| Akypo LF4 | 7.5% v/v |
| Starch | 7.0% w/v |
| Bactrachem BF2 | 3.0% v/v |
| Triton DF12 | 0.025% v/v |

the remainder being demineralised water and incidental impurities. One part by weight of the concentrate was diluted with 50 parts by volume of water to form a working strength fount solution.

EXAMPLE 6

A formulation was prepared which comprised the following:

| | |
|---|---|
| Glycerine | 5.0% v/v |
| Trisodium citrate | 4.0% w/v |
| Citric acid | 2.0% w/v |
| Calgon R | 4.0% w/v |
| Nonanoic acid | 3.0% v/v |
| Triethanolamine (90% in demineralised water) | 4.0% v/v |

-continued

| | |
|---|---|
| Benzoic acid | 1.0% W/V |
| Rewopol NEHS | 2.0% v/v |
| Akypo LF6 | 5.0% v/v |
| Gum Arabic | 5.0% w/v |
| Bacteron B6 | 3.0% v/v |
| Triton DF12 | 0.1% v/v |

the remaining being demineralised water and incidental impurities. One part by weight of the concentrate was diluted with 50 parts by volume of water to form a working strength fount solution.

What is claimed is:

1. A fount solution adapted for use in a planographic printing process, said solution comprising water, an alkanoic acid, a di or tri alkanolamine, a substituted or unsubstituted benzoic acid, and a corrosion inhibiting surfactant comprising at least one alkoxy, aryloxy, or alkaryloxy carboxylic acid.

2. The fount solution of claim 1 wherein said surfactant has the formula $$R(OC_2H_4)_nOCH_2CO_2H$$

where R is an alkyl group and n is an integer in the range of 1 to 30.

3. The fount solution of claim 2 wherein R is an alkyl group having 4 to 8 carbon atoms.

4. The fount solution of claim 2 wherein said alkanoic acid is a carboxylic acid having 1 to 12 carbon atoms.

5. The fount solution of claim 2 containing a p-alkyl substituted benzoic acid.

* * * * *